US005414492A

United States Patent [19]

Kubota

[11] Patent Number: 5,414,492

[45] Date of Patent: May 9, 1995

[54] IMAGE FORMING APPARATUS WITH CIRCUIT BOARD COVER GUIDING RECORDING MEDIUM

[75] Inventor: Takeshi Kubota, Tama, Japan

[73] Assignee: Canon Kabushiki Kaisha, Tokyo, Japan

[21] Appl. No.: 276,501

[22] Filed: Jul. 18, 1994

Related U.S. Application Data

[63] Continuation of Ser. No. 988,914, filed as PCT/JP93/00053, Jan. 18, 1993, abandoned.

[51] Int. Cl.[6] ..... G03G 15/00

[52] U.S. Cl. ..... 355/200; 355/309

[58] Field of Search ..... 355/200, 309, 317; 346/134, 160, 160.1; 361/214; 400/624, 625, 642

[56] References Cited

U.S. PATENT DOCUMENTS

| | | | |
|---|---|---|---|
| 4,727,387 | 2/1988 | Israely | 346/160 |
| 4,760,492 | 7/1988 | Walsh | 361/214 |
| 5,136,324 | 8/1992 | Sugiura | 355/30 |
| 5,298,941 | 3/1994 | Tenpaku | 355/200 |

FOREIGN PATENT DOCUMENTS

| | | |
|---|---|---|
| 61-252181 | 11/1986 | Japan . |
| 1-267663 | 10/1989 | Japan . |
| 3-93576 | 4/1991 | Japan . |
| 4-240864 | 8/1992 | Japan . |

*Primary Examiner*—Joan H. Pendegrass
*Attorney, Agent, or Firm*—Fitzpatrick, Cella, Harper & Scinto

[57] ABSTRACT

There is provided an image forming apparatus characterized by including an electric circuit board on which an electric part is mounted, a conductive cover which covers the electric circuit board, an insulating member arranged between a lower surface of the electric circuit board and the conductive cover, and a grounding means for grounding the conductive cover. Wherein the conductive cover also serves as a convey guide for the recording medium.

68 Claims, 10 Drawing Sheets

IMAGE FORMING APPARATUS WITH CIRCUIT BOARD COVER GUIDING RECORDING MEDIUM

This application is a continuation of application Ser. No. 07/988,914 filed as PCT/JP93/00053, Jan. 18, 1993, abandoned.

TECHNICAL FIELD

The present invention relates to an image forming apparatus for recording an image on a recording medium.

In this case, as image forming apparatuses, an electrophotographic copying machine, a laser beam printer (LBP), an LED printer, a facsimile apparatus, a word-processor, and the like are included.

BACKGROUND ART

The background art of the present invention will be described below.

In recent years, a demand has arisen for a smaller image forming apparatus with improved operability. In order to satisfy this demand on the market, the applicant of the present invention has previously made an effective invention, and disclosed it in Japanese Patent Application No. 03-07719 (Japanese Patent Application Laid-Open No. 04-240864).

SUMMARY OF THE INVENTION

The invention of the present application has been made by improving the previous invention.

It is an object of the present invention to provide an image forming apparatus which can realize a further reduction in size.

It is another object of the present invention to provide an image forming apparatus which can minimize noise.

According to one main aspect of the present invention, there is provided an image forming apparatus for forming an image on a recording medium, characterized by comprising an electric circuit board on which electric parts are mounted, a conductive cover covering the electric circuit board, an insulating member arranged between a lower surface of the electric circuit board and the conductive cover, and grounding means for grounding the conductive cover. Wherein the conductive cover also serves as a convey guide for the recording medium.

According to another main aspect of the present invention, there is provided an image forming apparatus for forming an image on a recording medium, characterized by comprising, an electric circuit board on which electric parts are mounted, a conductive cover covering the electric circuit board, grounding means for grounding the conductive cover, a recording medium stacking unit arranged at a lower portion of the apparatus, and reversing means for guiding a recording medium fed from the recording medium stacking unit upon reversing the recording medium. Wherein the conductive cover constitutes a convey path for conveying the recording medium fed from the recording medium stacking unit to the reversing means.

With the above-described characteristic arrangement, the present invention realizes a further reduction in size of an image forming apparatus.

Such a reduction in size can be achieved because the above characteristic arrangement of the present invention eliminates necessity to form a space between the conductive cover and the electric circuit board in order to prevent noise.

In addition, according to still another aspect of the present invention, such a reduction in size can be achieved because the above-described characteristic arrangement eliminates necessity to form a special, separate guide in the path between the recording medium stacking unit and the reversing means.

BEST MODE OF CARRYING OUT THE INVENTION

An image forming apparatus according to an embodiment of the present invention will be described below with reference to the accompanying drawings.

Figure 1:
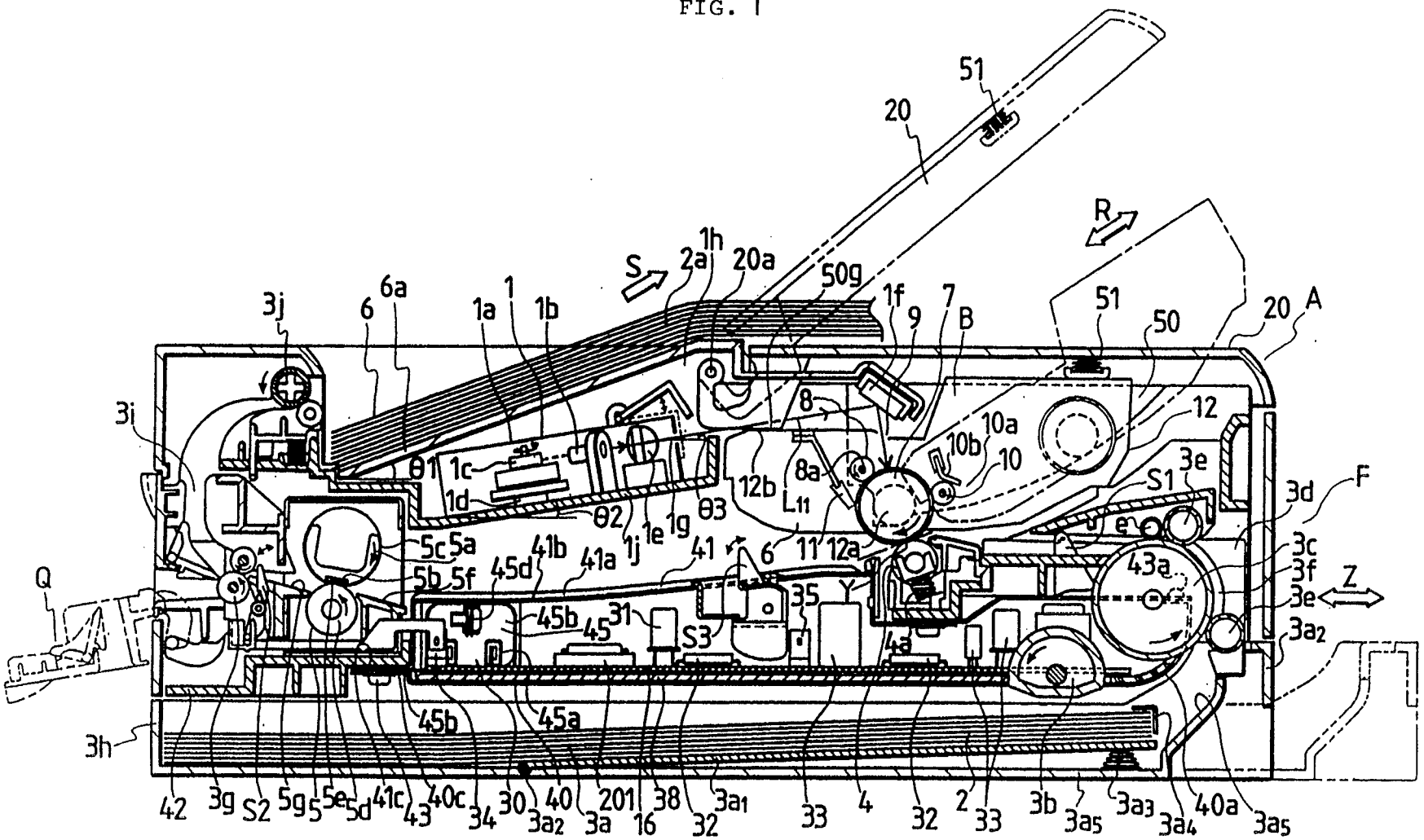
FIG. 1 is a sectional side view of a laser beam printer to which an embodiment of the present invention is applied.

FIG. 1 is a sectional side view of a laser beam printer as an image forming apparatus to which the present invention is applied.

The overall arrangement of the laser beam printer having a process cartridge mounted therein will be described first.

In this printer apparatus A, an optical image based on image information is radiated from an optical system 1 to form a toner image on a photosensitive drum as an image bearing member, as shown in FIG. 1. A recording medium 2 is conveyed upward by a feed roller **3*b* as a convey system in synchronism with the formation of the toner image. In an image forming unit as a process cartridge B, the toner image formed on the photosensitive drum 7 is transferred onto the recording medium 2 by a transfer means 4. Thereafter, the recording medium 2 is conveyed to a fixing means 5 to fix the toner image on the recording medium 2. The recording medium 2 is then discharged onto an upper stacking unit 6. In this case, as shown in FIG. 1, a recording medium 2*a* discharged from the apparatus main body is stacked on the upper stacking unit 6** such that a leading end portion of the medium is laid horizontally while its trailing end portion is inclined.

As shown in FIG. 1, in the process cartridge B constituting the image forming unit, the photosensitive drum 7 is rotated to uniformly charge its surface by using a charging roller 8 as a charging means, and an optical image from the optical system 1 is radiated on the photosensitive drum 7 through an exposure opening 9 formed in a cartridge frame 12, thus forming a latent image. Thereafter, a toner image corresponding to the latent image is formed by a developing sleeve 10 of a developing means to visualize the latent image. After the toner image is transferred on the recording medium 2 by the transfer means 4, the residual toner on the surface of the photosensitive drum 7 is removed by a cleaning plate 11 of a cleaning means. Note that the respective components such as the photosensitive drum 7 are stored, as cartridges, in the cartridge frame 12 constituting the housing.

The arrangements of the respective components of the printer apparatus A and the process cartridge B will be described next.

(Image Forming Apparatus)

The arrangements of the respective components of the printer apparatus A will be described. More specifically, the optical system, a convey system, the transfer means, the fixing means, an electric equipment unit, an electric equipment unit cover which also serves as a guide, a cartridge mounting means, and the overall arrangement of the apparatus will be described below in the order named.

(Optical System)

Figure 2:
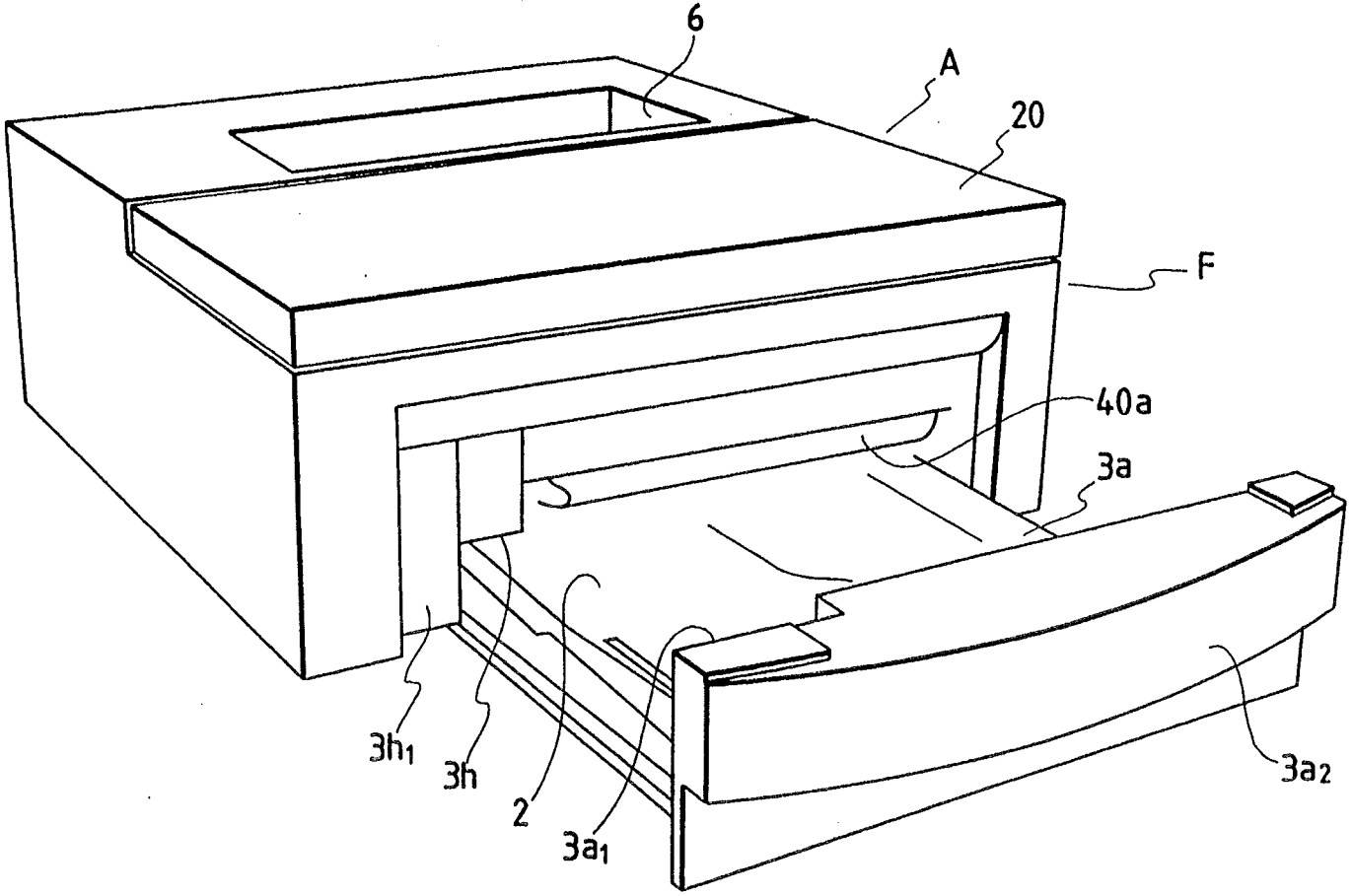
FIG. 2 is a perspective view showing the outer appearance of the laser beam printer in FIG. 1.
Figure 3:
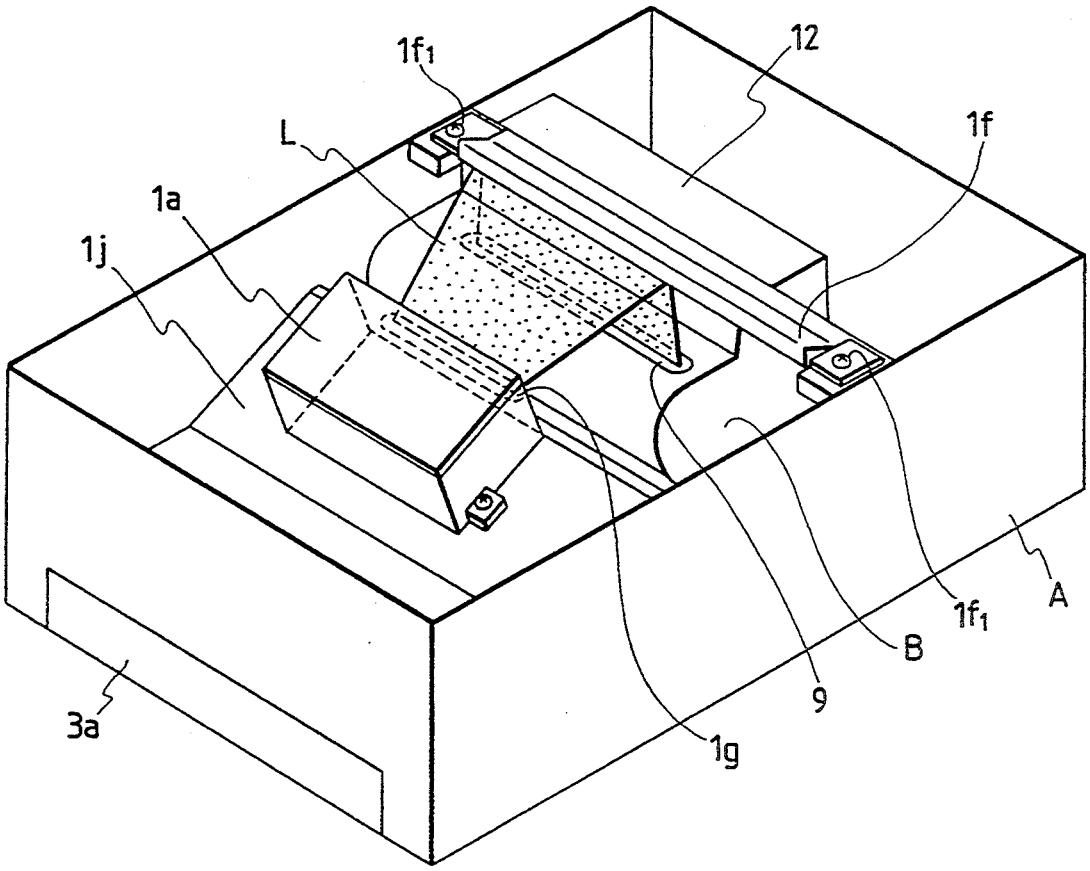
FIG. 3 is a perspective view showing the interior of the laser beam printer in FIG. 1.

The optical system will be described below with reference to FIGS. 1 to 3. FIG. 3 is a perspective view showing the interior of the apparatus main body.

The optical system 1 radiates an optical image on the photosensitive drum 7 by radiating light on the basis of image information read from an external unit or the like. As shown in FIG. 1, a laser scanner unit 1*a* of the apparatus main body A houses a laser diode 1*b*, a polygon mirror 1*c*, a scanner motor 1*d*, and an imaging lens 1*e*. Note that the laser scanner unit 1*a* is arranged within the height of the process cartridge B mounted in the apparatus main body.

Upon reception of an image signal from an external unit (host unit), e.g., a computer or a wordprocessor, the laser diode 1*b* emits light in accordance with the image signal, and radiates the light, as image light, on the polygon mirror 1*c*. The polygon mirror 1*c* is rotated at high speed by the scanner motor 1*d*. The image light reflected by the polygon mirror 1*c* is radiated on the rotating photosensitive drum 7 through the imaging lens 1*e* and a reflecting mirror 1*f*. As a result, the surface of the drum 7 is selectively exposed, and a latent image corresponding to the image information is formed thereon. In this case, the reflecting mirror 1*f* is fixed to the apparatus main body at a predetermined angle with a screw 1*f*1.

Reference numeral 1*g* denotes a unit opening through which light passing through the imaging lens 1*e* emerges from the unit toward the reflecting mirror 1*f*. In this case, the unit opening 1*g* is formed such that light emerging therefrom obliquely propagates upward. Reference numeral 1*h* denotes a laser shutter capable of opening/closing the unit opening 1*g*. The laser shutter 1*h* opens/closes the opening 1*g* upon interlocking with a mounting/dismounting operation of the process cartridge to be described later so as to prevent a laser beam L from unintentionally emerging outside the unit while the process cartridge is not mounted (the shutter 1*h* indicated by the solid line is in an open state, and the shutter 1*h* indicated by the broken line is in a closed state). A detailed description of the opening/closing mechanism of the shutter 1*h* will be omitted.

In this embodiment, the laser scanner unit 1*a* is mounted on a support plate 1*j* to be inclined upward so that the laser beam L can be emitted upward obliquely. More specifically, the laser scanner unit 1*a* is inclined upward in the same direction as an upwardly inclined stacking surface 6*a* of the stacking unit 6 arranged on the upper surface of the apparatus main body A. The laser scanner unit 1*a* substantially extends along the stacking surface 6*a*. Even if, therefore, the height of the apparatus main body A is minimized, since the inclination angle of the stacking surface 6*a* of the upper stacking unit 6 can be increased, a sufficient number of recording media can be stacked.

The inclination angle ($\theta 1$) of the stacking surface 6*a* with respect to the horizontal direction is preferably set to be about 15° to 45°, and more preferably about 20° to 40°, in consideration of the discharging performance. In the embodiment, the inclination angle was set to be about 20°. In addition, the inclination angle ($\theta 2$) of the laser scanner unit 1*a* with respect to the horizontal direction was set to be about 9° to 12.5°. Therefore, the emission angle ($\theta 3$) of the laser beam L with respect to the horizontal direction is about 9° to 12.5°. With this arrangement, about 50 to 100 recording sheets can be stacked on the upper stacking unit 6.

In the embodiment, the outer size of the laser beam printer for recording an image on a recording medium of a A4 size (210 mm×297 mm) could be reduced to the following ranges:

(1) height: about 130 mm to 145 mm
(2) depth: about 350 mm to 370 mm
(3) width: about 350 mm to 360 mm (Recording Medium Convey System)

The arrangement of a convey system 3 for conveying the recording medium 2 (e.g., a recording sheet, an OHP sheet (plastic sheet), a cloth, or a thin plate) will be described next. As shown in FIGS. 1 and 2, the convey system 3 of the embodiment has a mounting portion 3*h* of a cassette 3*a* on the bottom portion of the apparatus main body A. In this case, the cassette 3*a* is arranged on almost the entire bottom surface of the apparatus main body A. The cassette 3*a* can be inserted/withdrawn in/from the mounting portion 3*h* in the direction indicated by an arrow Z from a front surface F side. Note that positioning of the cassette 3*a* with respect to the mounting portion 3*h* is performed by bringing a cassette-side abutment portion 3*a*1 into contact with a main-body-side abutment portion 3*h*1. The recording media 2 stored in the cassette 3*a* are fed therefrom one by one, starting from the uppermost recording medium, by a pickup roller 3*b*. A reverse roller is then rotated, in accordance with an image forming operation, to convey the recording medium 2 to a transfer region Y of the image forming unit. After the image forming operation, the recording medium 2 is further conveyed to the fixing means 5. The recording medium 2 is then discharged onto the upper stacking unit 6 by a discharging roller pair 3*j*. In this case, a roller 3*e* is rotated upon rotation of a reverse roller 3*c*. Note that reference numeral 3*a*2 denotes a cassette grip.

The above arrangement will be described in more detail below.

In response to a print start signal, a driving force is transmitted to a one-direction control clutch (not shown) to rotate the pickup roller 3*b* once. As a result, one of the recording media 2 in the cassette 3*a* is fed in the forward direction of the cassette 3*a* (the forward direction of the apparatus main body A). The fed recording medium 2 is conveyed to a rear position in the apparatus main body A through a first reverse sheet path 3*f* constituted by the reverse roller 3*c*, a guide 3*d*, the roller 3*e*, and the like, while the recording medium 2 is reversed through 180°. The recording medium 2 is guided to a tight contact nip portion Y (transfer region) between the photosensitive drum 7 and the transfer means 4, and the toner image formed on the surface of the drum 7 is transferred onto the recording medium 2. The recording medium 2 on which the toner image is transferred is guided by a cover 41 (to be described later) to reach the fixing means 5. When passing through the fixing means 5, the toner image is fixed on the recording medium 2 by heat and pressure. Upon passing through the fixing means 5, the recording medium 2 reaches a curved second reverse sheet path 3*i* through a relay convey roller pair 3*g*. When passing through the second reverse sheet path 3*i*, the recording medium 2 is reversed through 180° again and is discharged onto the upper stacking unit 6 by the discharging roller pair 3*j*.

In the printer apparatus of the embodiment, the recording medium 2 fed once from the cassette 3*a*, arranged on the bottom portion of the apparatus, toward the front portion of the apparatus is reversed when passing through the first reverse sheet path 3*f*, and is moved toward the rear portion of the apparatus. In the process of moving toward the rear portion of the apparatus, the recording medium 2 undergoes toner image transfer processing in the transfer region Y. Thereafter, the toner image is fixed on the recording medium 2 by the fixing means 5. After the fixing operation, the recording medium 2 is reversed again through the second reverse sheet path 3*i* and is moved toward the front portion of the apparatus. The recording medium 2 is then discharged onto the upper stacking unit 6 on the upper portion of the apparatus. That is, in the embodiment, the convey path for recording media has a letter of "S" shape.

According to the embodiment, therefore, the space for installing the apparatus can be further reduced. Moreover, the recording media 2 which have undergone image recording processing are sequentially stacked on the upper stacking unit 6 with the image-formed surfaces facing down.

Note that the cassette 3*a* can be manually withdrawn-/inserted from/in the mounting portion 6 (in the direction indicated by the arrow Z in FIG. 1) by the operator at the front side of the apparatus, and replenishment of the recording media 2 is performed while the cassette 3*a* is withdrawn from the mounting portion 6. The cassette 3*a* will be described here. Reference numeral 3*a*1 denotes a stacked matter which can be pivoted about a shaft 3*a*2; 3*a*3, a push-up spring for pushing a stacking plate 2 upward; 3*a*4, a separation pawl for separating the recording media 2 one by one when they are fed; and 3*a*5, a guide for guiding the leading end of the fed recording medium 2 to the position between the reverse roller 3*c* and the roller 3*e*. The stacking plate 3*a*1, the push-up spring 3*a*3, the separation pawl, the guide 3*a*5, and the like are disposed in a cassette box 3*a*5, and hence can be withdrawn together as the cassette 3*a*.

Sensors S1, S2, and S3 arranged in the convey path for the recording medium 2 will be described below.

The sensor S1 is a registration sensor, which detects the leading end of the recording medium 2 fed from the cassette 3*a* to the transfer region Y to regulate the laser write timing of the laser scanner unit 1*a*, and also detects the presence/absence of a residual recording medium at the start time of the apparatus main body.

The sensor S2 is a discharge sensor (a detecting member on the rear side of the fixing unit), which detects the arrival of the leading end and the departure (passage) of the trailing end of the recording medium 2 which has passed through the fixing means 5, and also detects the presence/absence of a residual recording medium at the start time of the apparatus.

The sensor S3 is a sensor (a detecting member on the front side of the fixing unit) arranged in the sheet path extending from the transfer region Y to the fixing means 5 to detect the presence/absence of a recording medium.

With this arrangement, when a jam occurs in the apparatus, a control unit 200 detects the jam in accordance with the feed timing and the relationship between signals from the sensors S1 and S2, thus bringing the apparatus main body to an emergency stop. In addition, the occurrence of the jam is displayed.

Assume that the recording medium 2 is jammed in the fixing unit 5. In this case, the arrival of the leading end of the recording medium is not detected by the discharge sensor S2 in spite of the fact that the time required for the leading end of the recording medium to arrive at the discharge sensor S2 as the detecting member on the rear side of the fixing unit has elapsed since time counting is started from the feed timing. Therefore, the control unit 200 determines that the recording medium is jammed in the fixing unit 5 in a wound state, and brings the apparatus to an emergency stop. Note that the jammed recording medium is removed upon opening the rear portion of the apparatus main body A (indicated by a broken line Q in FIG. 1).

(Transfer Means)

The transfer means 4 transfers a toner image, formed on the photosensitive drum 7 in the image forming unit, onto the recording medium 2. As shown in FIG. 1, the transfer means 4 of the embodiment is constituted by a transfer roller 4. More specifically, the recording medium 2 is pressed against the photosensitive drum 7 of the process cartridge B by the transfer roller 4, and a voltage having a polarity opposite to that of the toner image formed on the photosensitive drum 7 is applied to the transfer roller 4, thus transferring the toner image, formed on the photosensitive drum 7, onto the recording medium 2. Reference numeral 4*a* denotes a spring for pressing the transfer roller 4 against the photosensitive drum 7.

(Fixing Means)

The fixing means 5 fixes the toner image, transferred onto the recording medium 2 by applying the voltage to the transfer roller 4, on the recording medium 2. FIG. 1 shows the arrangement of the fixing means 5. More specifically, reference numeral 5*a* denotes a heat-resistant film guide member having a substantially semicircular trough-like cross-section; 5*b*, a flat ceramic heater (heating member) disposed on the middle portion of the lower surface of the film guide member 5*b* to extend along its longitudinal direction; 5*c*, a cylindrical (endless) thin film (fixing film) consisting of a heat-resistant resin, which is loosely fitted on the film guide portion 5*a* having the ceramic heater; and 5*d*, a pressure roller which is arranged below the film guide portion 5*a* and is always biased upward by a push-up spring (not shown) to be pressed against the ceramic heater 5*b* through the film 5*c*. That is, the ceramic heater 5*b* and the pressure roller 5*d* are pressed against each other through the film 5*c* to constitute a fixing nip portion 5*e*.

The ceramic heater 5b is energized by an energization system to generate heat, and is controlled by a temperature control system of the control unit 200 (FIG. 7) (to be described later) to a predetermined fixing temperature.

The pressure roller 5d is rotated at a predetermined peripheral speed in the counterclockwise direction indicated by the arrow. Owing to a frictional force generated upon rotation of the pressure roller 5d, the cylindrical film 5c is rotated around the outer surface of the film guide portion 5a at a predetermined peripheral speed in the clockwise direction indicated by the arrow while the film 5c is in tight contact with the lower surface of the ceramic heater 5b at the fixing nip portion 5e and is slidably moved along the heater surface.

The recording medium 2 which has undergone image transfer processing and is conveyed to the fixing unit 5 is guided to an inlet guide 5f and is inserted between the cylindrical film 5c and the pressure roller 5d which are being rotated at the fixing nip portion 5e between the temperature-controlled ceramic heater 5b and the pressure roller 5d. The recording medium 2 then comes into tight contact with the lower surface of the ceramic heater 5b through the film 5c and passes through the fixing nip portion 5e together with the film 5c in an overlapped state.

In the process of passing through the fixing nip portion 5e, the non-fixed toner image on the recording medium 2 is heated upon receiving the heat from the ceramic heater 5b through the film filter 5c, thus fixing the image on the recording medium 2.

The recording medium 2 which has passed through the fixing nip portion 5e is separated from the surface of the film 5c which is being rotated, and is guided to the convey roller pair 3g by an outlet guide 5g.

(Electric Equipment Unit)

Figure 4:
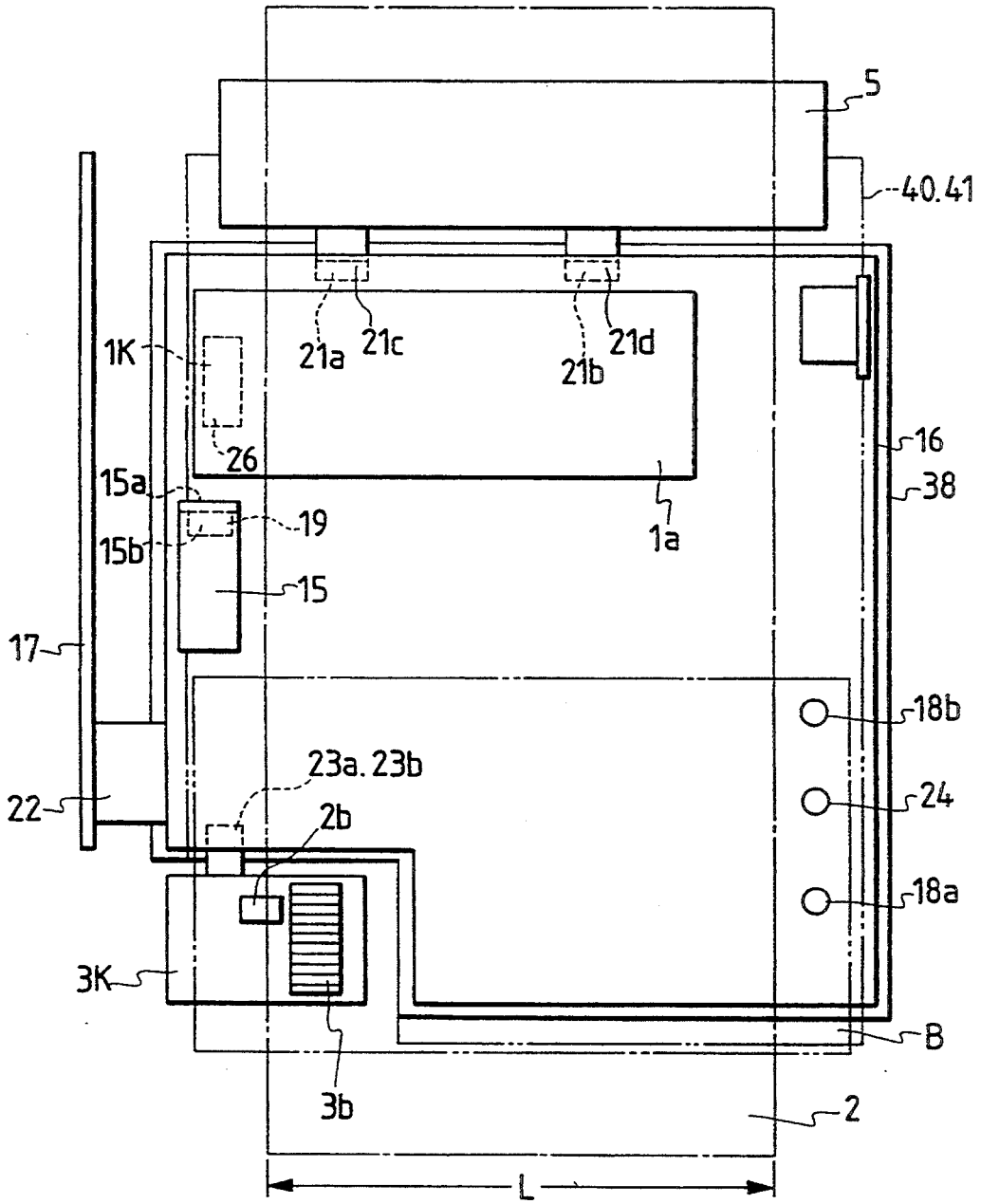
FIG. 4 is a plan view of a portion near a composite electric circuit board.

The electric equipment unit will be described below with reference to FIGS. 1, 4, and 7. FIG. 4 is a plan view of a portion near an electric circuit board 16, in which an insulating sheet 38 is indicated by the solid line, and upper and lower covers 40 and 41 are indicated by alternate long and two short dashed lines.

In the embodiment, all electric parts such as an AC input unit, a DC power supply unit, a high-voltage power supply unit, a control circuit unit, switches, sensors, and connectors are mounted on one printed board. More specifically, the following electric parts are mounted on one printed board, i.e., the electric circuit board 16, at a high density: an AC input unit 401 for receiving AC power from an external commercial power supply 400 and removing noise; a DC power supply unit 402 for converting the AC power into DC power of 5 or 24 V; a high-voltage power supply unit 403 for supplying power to the process cartridge B (the developing means 10 and the charging roller 8) and the transfer roller 4; and the controller unit 200 such as a CPU for controlling the overall operation of the image forming apparatus. Reference numeral 17 denotes an image processing circuit board for performing image processing for a character, a symbol, or the like in accordance with a print signal from a host computer. The image processing circuit board 17 is arranged to be perpendicular to the electric circuit board 16.

A method of electrically connecting the electric circuit board 16 to other main units will be described next.

A feed unit 3k is connected to the electric circuit board 16 such that contact electrodes 23a and 23b, each consisting of a material such as phosphor bronze or SUS are brought into contact with electrode portions 23c and 23d on the electric circuit board 16. Upon electrical connection between the feed unit 3k and the electric circuit board 16, ON/OFF control of a solenoid 3m arranged on the feed unit 3k is performed. The solenoid 3m is ON/OFF-controlled to drive/stop the pickup roller 3b.

Both the process cartridge B and the transfer roller 4 are electrically connected to the electric circuit board through contact springs 18a, 18b, and 24, each consisting of a material such as SUS and protruding upward from a portion, of the electric circuit board 16, which is located outside a width L (FIG. 4) of the maximum recording medium. With this electrical connection, the process cartridge B and the transfer roller 4 receive power or grounded. As shown in FIG. 4, since the contact springs 18a, 18b, and 24 are disposed outside the width of a recording medium of the maximum size, they do not interfere with the conveyance of recording media. In addition, as shown in FIG. 1, since the laser scanner unit 1a is disposed across the convey path for recording media, the effective use of the space can be realized. The spring 18a serves to apply a developing bias to the developing means 10. The spring 24 serves to ground the photosensitive drum 7. The spring 18b serves to apply a voltage to the charging roller 8 to perform a primary charging operation.

A driving motor 15 is electrically connected to the electric circuit board 16 such that a connector 15b on a motor board 15a disposed on a side surface of the driving motor 15 and a connector 19 on the electric circuit board 16 are fitted to each other.

The image processing circuit board 17 is electrically connected to the electric circuit board 16 at a side of the circuit board 16 such that a connector 22 fixed to the circuit board 17 is connected to a connector 22a fixed to the circuit board 16. The image processing circuit board 17 communicates with the control unit 200 (CPU 201) in the electric circuit board 16.

In addition, the fixing unit 5 is connected to the electric circuit board 16 below the convey path for recording media such that an AC connector 21a and a DC connector 21b, both fixed to the fixing unit 5, are connected to an AC connector 21c and a DC connector 21d, both fixed to the electric circuit board 16. With this electrical connection, the fixing unit 5 receives power and is controlled.

As described above, the main units in the image forming apparatus can be directly and easily connected to the electric circuit board 16 without using relays such as harnesses. With this arrangement, the number of components can be reduced by omitting harnesses and the like, and the operability in assembly and maintenance can also be improved. Furthermore, since a connection error and the like can be prevented, the reliability of the image forming apparatus can be improved.

As shown in FIG. 4, the laser scanner unit 1a is also connected to the electric equipment unit 16 at a position outside the width of the convey path for recording media such that a connector 5b on the relay board 1k side and a connector 26 on an electric equipment board 16a are connected to each other. As described above, according to the embodiment, all the units, in the image forming apparatus, which require electrical control can be connected to the electric circuit board 16. That is, the electrical control functions required for the image forming apparatus can be concentrated on the electric circuit board 16. Therefore, by intensively managing the quality of the electric circuit board 16, the quality of the image forming apparatus can be guaranteed.

Of all the electric parts mounted on the electric circuit board 16, FIG. 1 shows an AC inlet 30, the CPU 201, a quartz member 31, various resistors 32, various capacitors 33, the photointerrupter of the sensor S2, and a photointerrupter 35 of the sensor S3.

(Electric Circuit Board Cover Serving as Guide)

The electric circuit board cover and its function as a convey guide for recording media will be described below with reference to FIG. 1.

As shown in FIG. 1, in the embodiment, the composite electric circuit board 16 is located above the feed cassette 3*b* and is arranged horizontally below the laser scanner unit 1*a* and the process cartridge B. The lower surface of the board 16 is covered with a lower cover 40 consisting of a material with a high conductivity, e.g., a steel plate with an aluminum coat, through an insulating sheet 38. Similarly, the upper surface of the board 16 is covered with an upper cover 41 consisting of a steel plate with an aluminum coat. Note that a plurality of ribs 41*a* are arranged in the widthwise direction. The circuit board 16 is hermetically surrounded by the upper and lower covers 40 and 41 mounted integrally, thus restricting noise. In addition, since the insulating sheet 38 is inserted between the circuit board 16 and the lower cover 40, no short circuit occurs between the board 16 and the cover 40 without forming any unnecessary space therebetween. With this arrangement, a further reduction in size (profile) of the apparatus can be achieved. The arrangement will be described in more detail below.

In the embodiment, the lower cover 40 extends almost horizontally from an intermediate portion (below the fixing unit 5) of the cassette 3*a* to its distal end (at which the separation pawl 3*a*4 is disposed), and has a curved portion 40*a* extending upward from the distal end of the cassette 3*a*. This curved portion 3*a*5 and the above-mentioned guide 3*a*5 constitute part of the convey path for recording media. That is, the leading end of the recording medium 2 fed from the cassette 3*a* is brought into contact with the guide 3*a*5 and is guided therealong to the position between the roller 3*c* and the roller 3*e*. As the conveyance of the recording medium proceeds with its leading end being clamped between the roller 3*c* and the roller 3*e*, the recording medium fed from the cassette 3*a* is conveyed while its surface is brought into contact with the curved portion 40*a*, i.e., while the recording medium is guided by the curved portion 40*a*.

One end of the upper cover 41 is joined to the lower cover 40 at a position near the reverse roller 3*c*. The other end of the upper cover 41 is in surface contact with the lower cover 40 at a position below the fixing unit 5 through a flat portion 41*b* of the cover 41 extending from a position near the transfer region Y to a position near the inlet guide 5*f* of the fixing unit 5. This contact portion is fixed to a main body frame 42 with a screw 43. With this arrangement, the flat portion 41*b* can reliably and stably guide a recording medium, which has undergone toner image transfer processing, to the fixing unit 5. Note that ribs 41*a* are arranged on the flat portion 41*b* in the widthwise direction. Since the recording medium is conveyed over the ribs 41*a*, smooth conveyance is realized by reducing the contact area between the recording medium and the flat portion 41*b*.

In order to allow the upper and lower covers 40 and 41 to serve as a convey guide for recording media, it is important to make both the upper and lower covers 40 and 41 conductive and grounded and let them have shapes suitable for a guide. The operator normally stores recording media in the cassette 3*a* upon loosening a set of recording media to improve their separability. In this case, even if a recording medium is charged, the recording medium can be smoothly conveyed while it is guided by the covers 40 and 41 without being electrostatically attracted to the covers 40 and 41.

In the embodiment, as will be described later, the covers 40 and 41 are reliably grounded by using an AC inlet. It is, however, apparent that since the covers 40 and 41 can be grounded by ensuring sufficient contact between the covers and the conductive member of the apparatus main body, the AC inlet need not always be used.

Referring to FIG. 1, reference numeral 45 denotes an AC inlet. A terminal 45*a* of the AC inlet 45 is connected to the composite electric circuit board 16. A sheet metal tongue portion 45*b* of the AC inlet 45 is fixed to the main body frame 42 with the screw 43 while the portion 45*b* is clamped between edges 40*c* and 41*c* of the upper and lower covers 40 and 41. Therefore, the upper and lower covers 40 and 41 are reliably grounded through the main body frame 42 to allow the charges of the recording medium 2 to escape to the main body frame 42 through the upper and lower covers 40 and 41 and their edges. Note that reference numeral 45*d* denotes a machine screw, with which the ground terminal of the inlet 45 is fixed to the sheet metal of the upper cover 41. In the above-described embodiment, a steel cover obtained by forming an aluminum coat or the like on a steel plate is used as each of the upper and lower covers.

The present invention is not limited to this. For example, a deposition sheet obtained by depositing a conductive material such as aluminum on a steel plate or the like may be used. If the upper and lower covers 40 and 41 are left grounded, a large amount of charges on the lower surface of the recording medium 2 escape, and offset may be caused. For this reason, for example, a Teflon-containing paint or the like is preferably coated on the surfaces of the upper and lower covers 40 and 41 to set their surface resistances to be about $10^7$ Ω to $10^{16}$ Ω. In the embodiment, the surface resistances are set to be about $10^{11}$ Ω. As a material for the insulating sheet 38, a resin material such as polycarbonate, ABS, or high-impact styrol may be used.

As described above, according to the embodiment, since the electric circuit board is covered with the cover, noise can be minimized. In addition, since the cover can also serve as a convey guide for recording media, a reduction in size of the apparatus can be realized. Furthermore, by forming the cover from a high-rigidity material (e.g., a steel plate), the cover can also serve as a reinforming member for the main body frame. Note that the upper and lower covers 40 and 41 are integrally joined to each other with the screw 43 at one end and with a screw 43*a* at the other end in surface contact.

(Process Cartridge Mounting Means)

Figure 5:
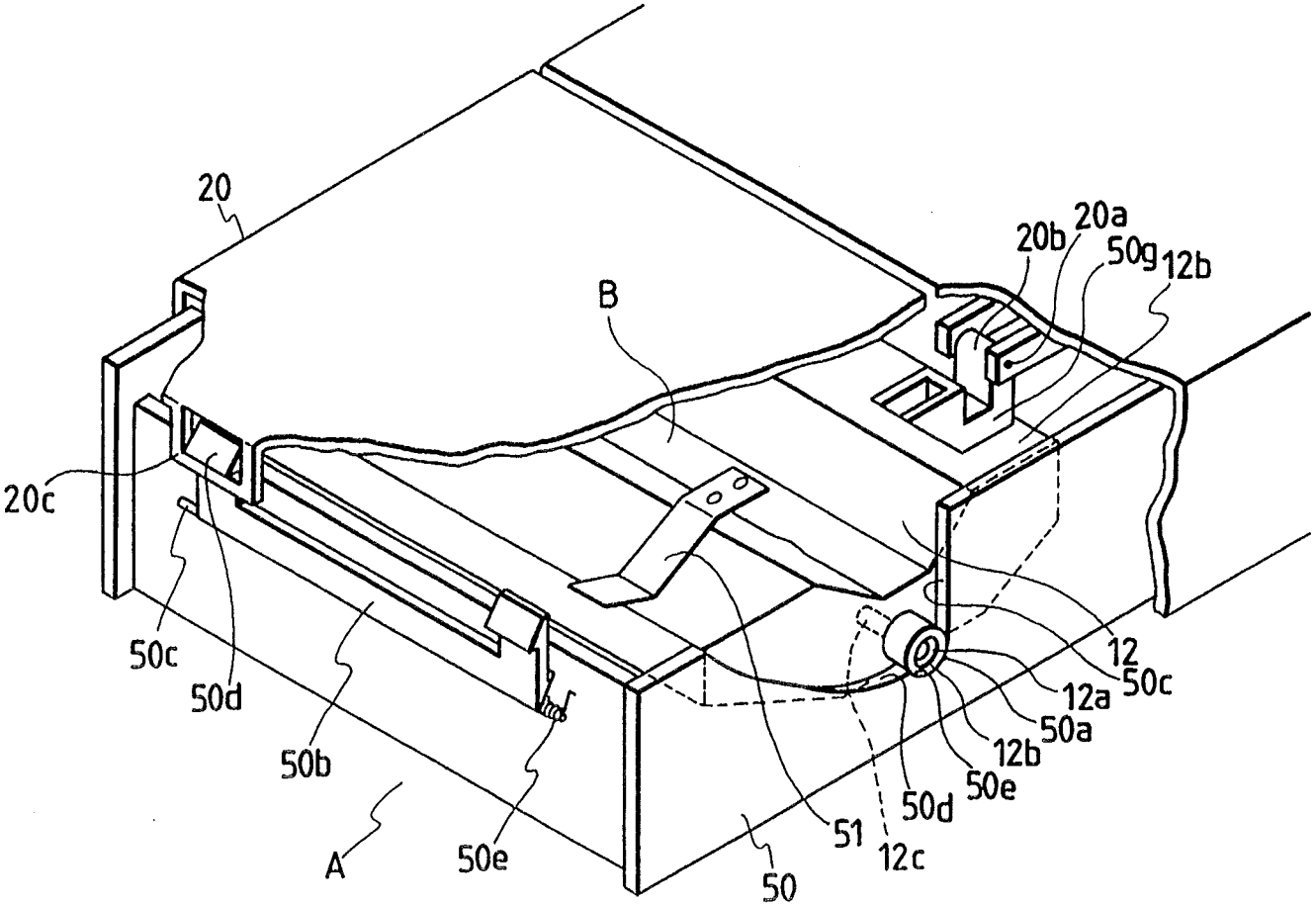
FIG. 5 is a partially cutaway perspective view of a portion of an opening/closing cover.
Figure 6:
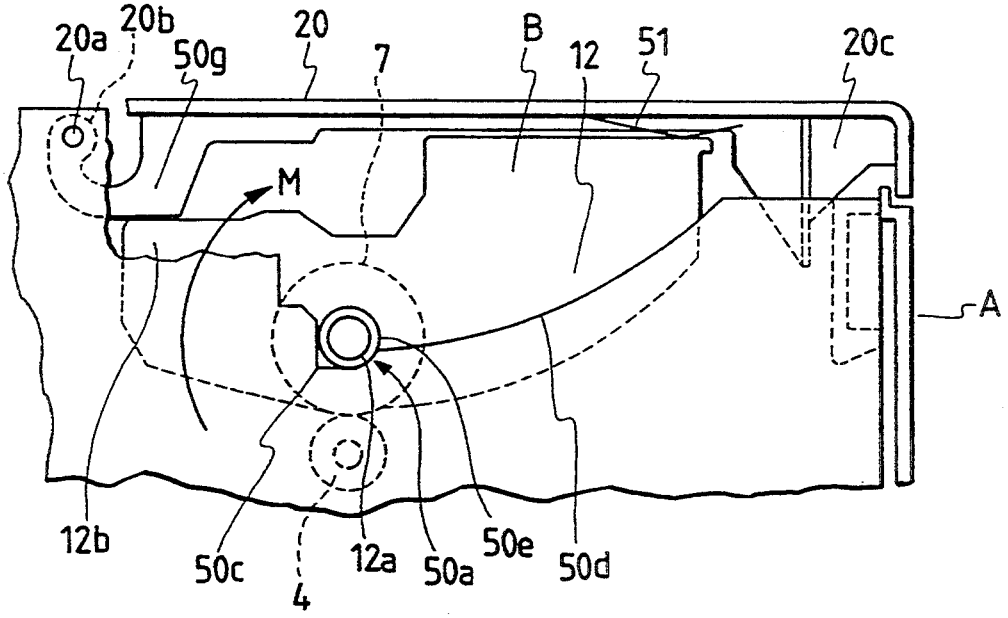
FIG. 6 is a side view showing an ordinary state wherein a process cartridge is mounted.

The process cartridge mounting means will be described below with reference to FIGS. 1, 5, and 6. FIG. 5 is a perspective view showing a state wherein the process cartridge is mounted in the apparatus with its opening/closing cover being closed. FIG. 6 is a side view of the process cartridge, in which part of the structure is schematically illustrated as compared with FIG. 1, and the shapes and the like of some parts are different from those in FIG. 1.

The image forming apparatus A incorporates the cartridge mounting means for mounting the process cartridge B. Mounting/dismounting of the process cartridge B with respect to the apparatus main body A is performed by opening an opening/closing cover 20. More specifically, the opening/closing cover 20 is fixed to an upper portion of the apparatus main body B with a hinge 20*a*. As indicated by the alternate long and two short dashed lines in FIG. 1, when the opening/closing cover 20 is opened, a cartridge mounting space in the apparatus main body B is seen. Left and right guide members are fixed to the left and right walls inside the apparatus main body. Guides for inserting the process cartridge B are formed on the left and right guide members. When the process cartridge B is inserted along the guides, and the opening/closing cover 20 is closed, the process cartridge B is mounted in the image forming apparatus A. According to the embodiment, the process cartridge B is mounted between the mounting portion 3*h* of the feed cassette 3*a* and the stacking unit 6, on which the recording medium 2*a* which have undergone recording processing are stacked, in a direction perpendicular to the apparatus, by a mounting method to be described in detail below.

The method will be described in detail below.

Referring to FIG. 5, a main frame 50 constituting the main body has a positioning portion 50*a* for the process cartridge B. The process cartridge B incorporating the photosensitive drum, the developing means, the cleaning means, and the like has a drum positioning pin 12*a* for axially supporting the photosensitive drum 7 on a process cartridge frame member 12. The drum positioning pin 12*a* includes an outer flange 12*b* serving as a bearing, and a drum shaft 12*c* axially supported on the outer flange 12*b*. The photosensitive drum 7 fixed to the drum shaft 12*c* is rotated coaxially with the outer flange 12*b*. When the opening/closing cover 20 is opened to mount the process cartridge B in the main body, the positioning portion 50*a* is located on the deeper side of a guide track 50*d* of the main frame 50 of the main body, along which the outer flange 12*b* of the drum positioning pin 12*a* is guided, and is positioned by a rear portion 50*c* and a semicircular portion 50*e* located below the rear portion 50*c* to oppose it.

That is, the rear portion 50*c* is located at a position to resist a tooth load applied to a drum gear (not shown), and the semicircular portion 50*e* is brought into contact with the outer surface of the outer flange 12*b*. The opening/closing cover 20, which is opened/closed when the process cartridge B is replaced or jam processing is performed, has a hinge 20*b* engaged with an axial support portion 20*a* of the main frame 50. With this arrangement, the opening/closing cover 20 can be opened/closed. When a lock hole portion 20*c* formed in the open-side end portion of the opening/closing cover 20 is engaged with a lock 50*b* formed on the main frame 50, the opening/closing cover 20 is closed. A pawl 50*d*, of the lock 50*b*, which is pivotally supported by a shaft 50*c*, is biased outward to a certain limit by a torsion coil spring 50*e*. An abutment portion 50*g* and a pressure spring 51 are formed on the rear surface of the opening/closing cover 20. The abutment portion 50*g* is brought into contact with an abutment portion 12*b* of the process cartridge frame member 12. The pressure spring 51 presses the front portion of the process cartridge B.

As shown in FIG. 1, the process cartridge B is inserted from the direction indicated by an arrow R upon opening the opening/closing cover 20, and is pushed into the apparatus main body until the outer flange 12*b* of the drum positioning pin 12*a* is brought into contact with the rear portion 50*c* of the positioning portion 50*a* of the main frame 50. In this case, since the photosensitive drum 7 is pushed up by the pressing force of the transfer roller 4 but is not restricted by the abutment portion 50*g* and the pressure spring 51 of the opening/closing cover 20, the process cartridge B is not positioned yet. When the opening/closing cover 20 is closed until the lock hole portion 20*c* is engaged with the lock 50*b*, the process cartridge abutment portion 50*g* of the opening/closing cover 20 is brought into contact with the abutment portion 12*b* of the cartridge frame member 12, thus pushing up the rear portion of the process cartridge B. The outer flange 12*b* of the photosensitive drum positioning pin 12*a* is then brought into contact with the positioning portion 50*a* of the main frame 50. As a result, the photosensitive drum 7 is positioned.

In addition, since the process cartridge pressure spring 51 presses the front portion of the process cartridge B downward, the center of the photosensitive drum 7 is always pressed against the positioning portion 50*a* of the main frame 50 with the abutment portion 50*g* serving as a fulcrum. When the operation of the apparatus main body is started in this state, a drum gear (not shown) receives a rotational force from a driving gear (not shown), and a moment M is applied to the overall process cartridge B with the photosensitive drum 7 serving as the center so as to rotate the process cartridge B in the clockwise direction in FIG. 6. In the embodiment, since the process cartridge abutment portion 50*g* of the opening/closing cover 20 receives this force, the posture of the process cartridge B is stabilized. Even if the moment M is abruptly eliminated due to a torque variation, and the process cartridge B tries to rotate in the counterclockwise direction, the process cartridge pressure spring 51 can absorb such a rotational force. The force, based on the tooth load of the drum gear (not shown), which tries to cause the process cartridge B to float acts more on the main body abutment portion 50*g* than on the pressure spring 51. Therefore, the process cartridge B does not float. As described above, in the embodiment, the posture of the process cartridge B is stably held even at the start time of the apparatus main body.

(Overall Arrangement of Apparatus)

In the embodiment, as described above, the recording medium 2 fed from the feed cassette 3*a* arranged at the lower portion of the apparatus passes through a so-called letter of "S"-shaped path, and is stacked on the stacking unit 6 arranged at the upper portion of the apparatus after the recording medium 2 is reversed twice. The feed cassette 3*a* is arranged at the lowermost portion of the apparatus in the direction of the height of the apparatus (in the vertical direction), and the electric circuit board 16 and the fixing unit 5 are arranged above the cassette 3*a* in this order. The laser scanner unit 1*a* and the process cartridge B are then arranged above the fixing unit 5. The stacking unit 6 on which recording media which have undergone recording processing are stacked is located at the uppermost portion of the apparatus to cross these components. In addition, the feed cassette 3*a* is completely housed in the apparatus main body A and does not protrude from the apparatus main body A. In the horizontal direction, the fixing unit 5, the laser scanner unit 1*a*, and the process cartridge B are arranged almost in a line in the apparatus. Furthermore, these three components are arranged so as not to overlap each other in the direction of height. The electric circuit board 16 is located above the feed cassette 3*a* and is arranged below the laser scanner unit 1*a* and the process cartridge B to cross them. In addition, since the upper and loser covers 40 and 41 are arranged to cover both the upper and lower surfaces of the electric circuit board 16, noise can be prevented almost completely. Moreover, since part of the covers 40 and 41 is located between the distal end of the feed cassette and the reverse roller 3*c*, and another part of the covers 40 and 41 is located between the copy region Y and the fixing unit 5, the covers also serve as a convey guide for recording media.

The laser scanner unit 1*a* is inclined in the same direction as the direction of inclination of the stacking surface 6*a* of the stacking unit 6 to emit a laser beam in the same direction of inclination.

With the above-described arrangement, the embodiment realizes a reduction in size of the apparatus in both the direction of height (vertical direction) and the horizontal direction. Furthermore, in spite of the reduction in height (low-profile), a sufficient number of recording media can be stacked on the stacking unit 6.

In addition, according to the embodiment, in the horizontal direction, the process cartridge B, the laser scanner unit 1*a*, and the fixing unit 5 are sequentially arranged in the apparatus in the order named from the apparatus front surface (front side) F side, and hence mounting/dismounting of the process cartridge B can be performed from the front side of the apparatus. Therefore, the mounting/dismounting performance of the cartridge is improved.

Furthermore, all the following operations can be performed from the front surface F side of the apparatus main body: the mounting/dismounting operation of the feed cassette (in the direction indicated by the arrow Z in FIG. 1), the mounting/dismounting operation of the process cartridge (in the direction indicated by the arrow R in FIG. 1), and removing of the recording media 2 which have undergone recording processing and are stacked on the stacking unit (in the direction indicated by the arrow S in FIG. 1). Therefore, the operability of these operations performed by the operator is greatly improved.

(Another Embodiment)

The schematic functional block diagram of the above-described apparatus will be described next with reference to FIG. 7.

Figure 7:
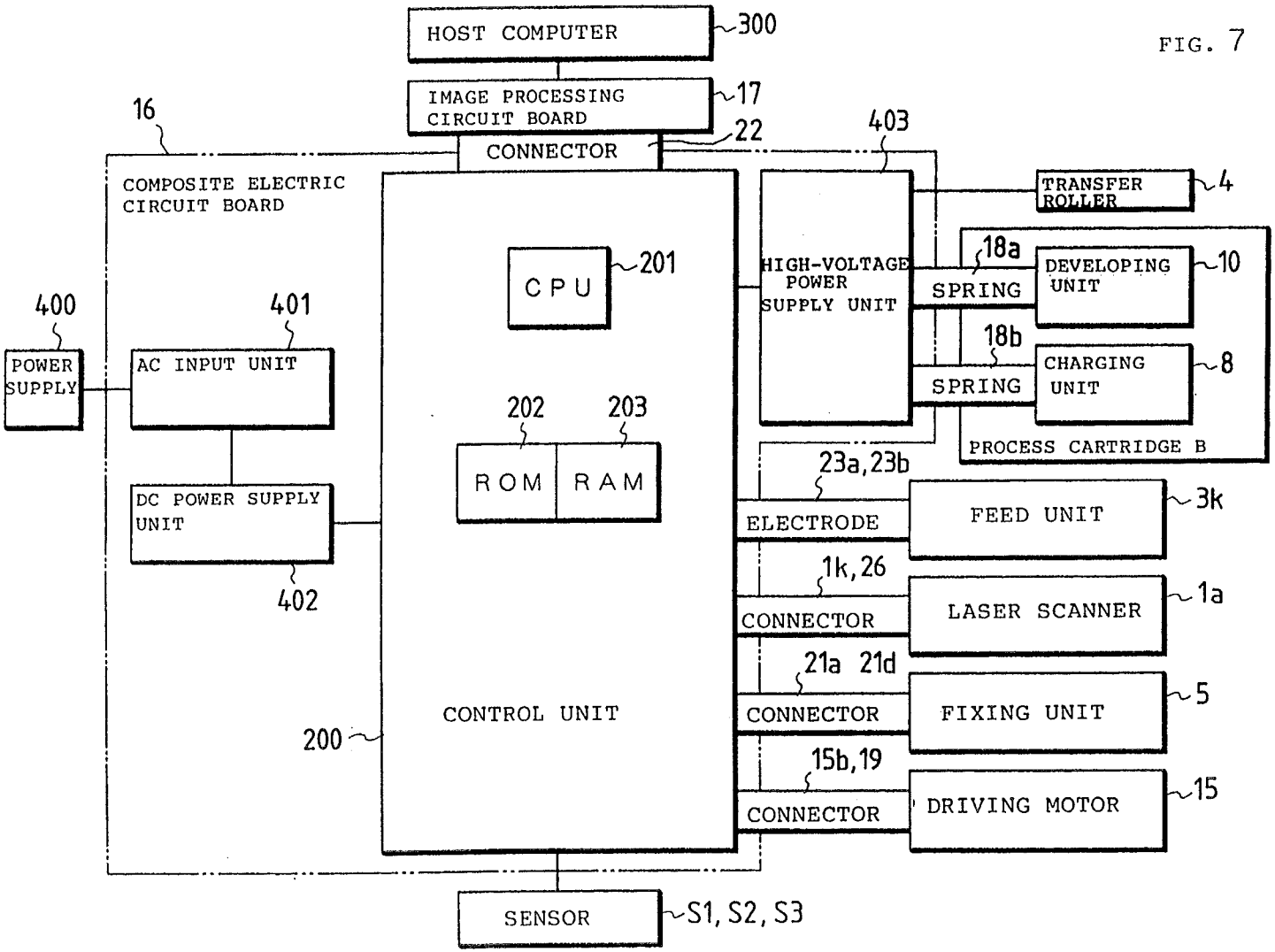
FIG. 7 is a schematic functional block diagram.

Referring to FIG. 7, reference numeral 200 denotes the control unit for performing the overall control of the apparatus. The control unit 200 includes the CPU 201 such as a microprocessor, the ROM 202 for storing control programs for the CPU 201 and various data, the RAM 203 used as a work area of the CPU 201 and designed to temporarily store various data, and the like.

The control unit 200 is arranged on the composite electric circuit board 16 and receives various information from a host computer 300 through the image processing circuit board 17. The control unit 200 controls the feed unit 3*k*, the laser scanner 1*a*, the transfer roller 4, the fixing unit 5, the driving motor 15, the developing unit 10, the charging roller 8, and the like on the basis of these pieces of information and the like.

In the embodiment, the composite electric circuit board, which is obtained by mounting all the AC input unit 401, the DC power supply unit 402, the high-voltage power supply unit 403, and the control circuit unit on one printed board, is exemplified. It is apparent, however, that even if the respective elements are mounted on different printed boards, and they are coupled to each other afterward, the same effect as that described above can be obtained. In addition, the electric circuit board need not include all the components described above, i.e., the AC input unit, the DC power supply unit, the high-voltage power supply unit, the control circuit unit, and the like, but may include at least one of them. However, the more the electric circuit board includes components, the better the effect is.

[Another Embodiment]

Another embodiment will be described in detail below with reference to FIGS. 8 to 10. Note that the same reference numerals in this embodiment denote the same parts having the same functions as in the above-described embodiment, and the above description will be quoted.

Figure 8:
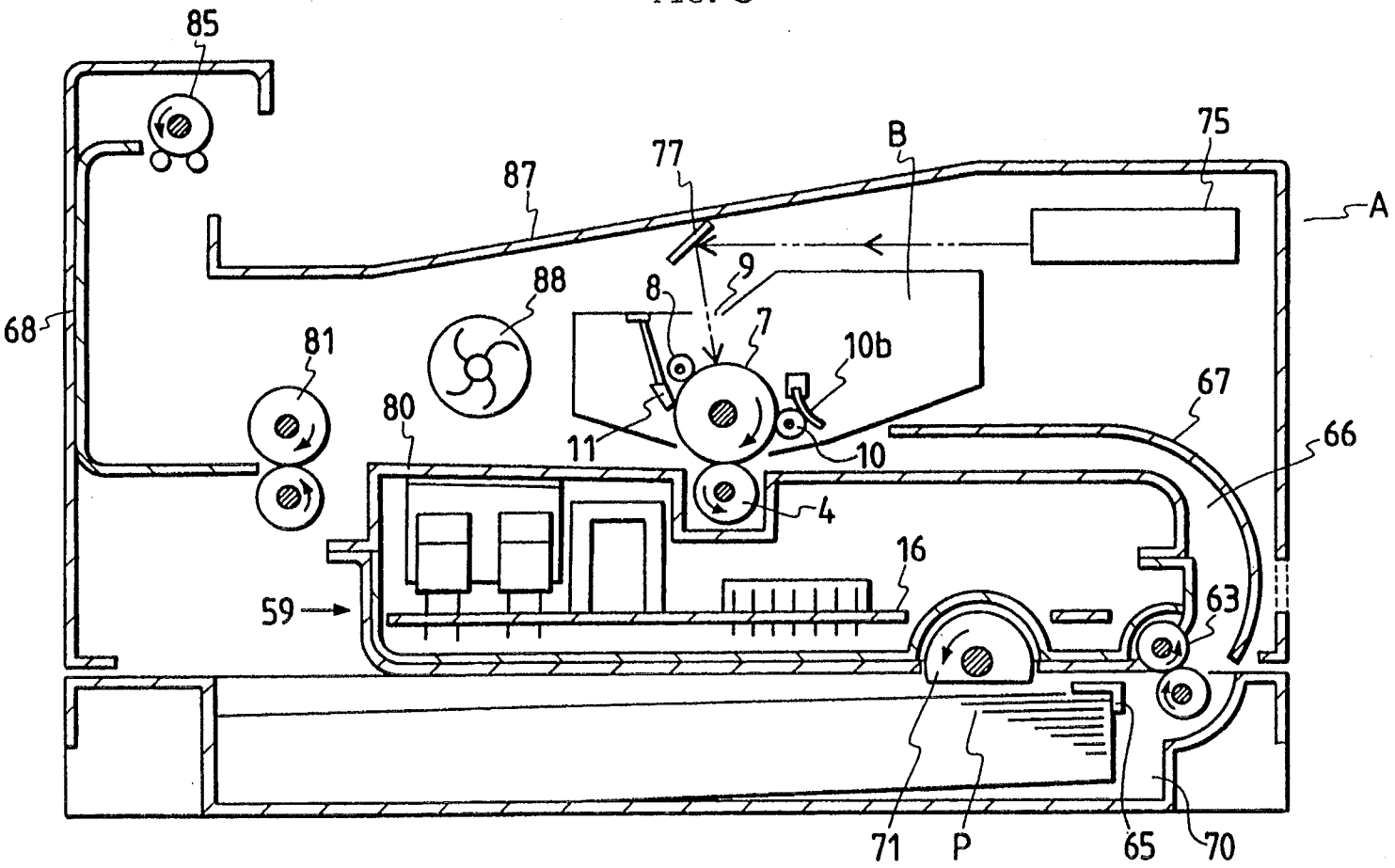
FIG. 8 is a sectional side view of a laser beam printer to which another embodiment of the present invention is applied.

FIG. 8 is a schematic sectional view of the main part of a compact laser beam printer. Referring to FIG. 8, a composite electric equipment unit 9 is arranged to be adjacent to the lower surface (lower side) of a convey guide plate 80. A paper feed cassette 70 in which recording sheets P are stored is arranged to oppose the convey guide plate 80 through the composite electric equipment unit 9.

The recording sheets P stacked on the paper feed cassette 70 are fed upon rotation of a pickup roller 71. At this time, the recording sheets P are separated one by one by a separation pawl 65. The recording sheet P is then conveyed to a transfer roller 4 by a convey roller pair 63 through a convey path 66 of an inlet convey guide 67 while the recording sheet P is aligned with a reference surface to prevent skew movement, and a registration sensor (not shown) is operated. In this case, this convey operation is synchronized with image information light which is emitted from a laser scanner unit 75 in response to a signal from the registration sensor, reflected by a reflecting mirror 77, and radiated on a photosensitive drum 7 of a process cartridge B.

The image formed on the photosensitive drum 7 upon radiation of the laser beam is developed by a toner. The toner image is then transferred onto the recording sheet P by the transfer roller A. The recording sheet P on which the toner image is transferred is separated from the photosensitive drum 7 and is conveyed to a fixing unit 81 through the convey guide plate 80. The toner image on the recording sheet is fixed by the fixing unit 81. The resultant sheet is guided by a convey guide 68 as a U-turn path and is discharged onto a discharge tray 87 on the upper portion of the apparatus main body by a discharging roller pair 85 with the image-formed surface of the recording sheet P facing down. Reference numeral 88 denotes a fan for producing an air flow.

The arrangement of portions around the composite electric circuit board 16 and the paper feed cassette 70 and their positional relationship in this embodiment will be described in detail next with reference to FIGS. 9 and 10.

Figure 9:
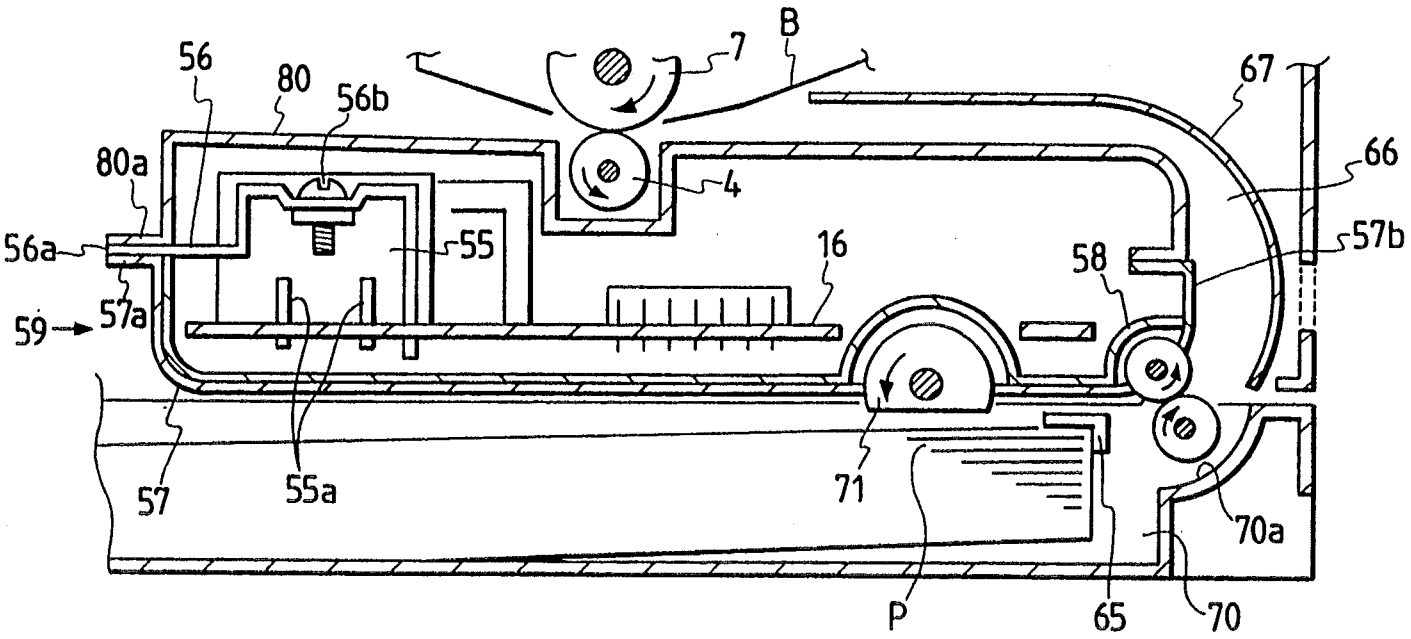
FIG. 9 is a sectional side view of a portion near an electric equipment unit.

FIG. 9 is a sectional view showing a convey unit (the convey guide plate 80), an electric equipment unit 59 (the composite electric circuit board 16, an electric equipment member for a power supply, a conductive cover 57, and an insulating case 58), and the paper feed cassette 70 in detail. FIG. 10 shows a detailed arrangement of part of the structure in FIG. 9.

In the electric equipment unit 59 shown in FIG. 9, at least one of the following electric equipment members is mounted on the composite electric circuit board 16: an AC power supply circuit through which the apparatus main body receives AC power, a low-voltage power supply circuit for converting the AC power into DC power, a high-voltage power supply circuit for converting low-voltage power into high-voltage power to perform image formation by an electrophotographic process, a control circuit for controlling the apparatus main body, and the like. The resultant circuit board 16 is then housed in one thin-walled insulating case 58 consisting of a molding resin, e.g., an ABS resin or a polycarbonate resin, so as to be formed into a unit. The unit is arranged on portion (bottom portion), of the apparatus main body 51, which is located close to and opposes the lower surface of the convey guide plate 80. Note that the insulating case 58 may be formed by bonding a vinyl chloride or polyethylene terephthalate film on a member consisting of a material other than the above-mentioned resin. The insulating case 58 is covered with a conductive cover 57 consisting of a rigid material having good surface conductivity, such as a steel plate with an aluminum coat or a steel plate with a zinc coat. The insulating case 58 is supported on the conductive cover 57. The conductive cover 57 is fixed to a frame (not shown) of the apparatus main body.

Figure 10:
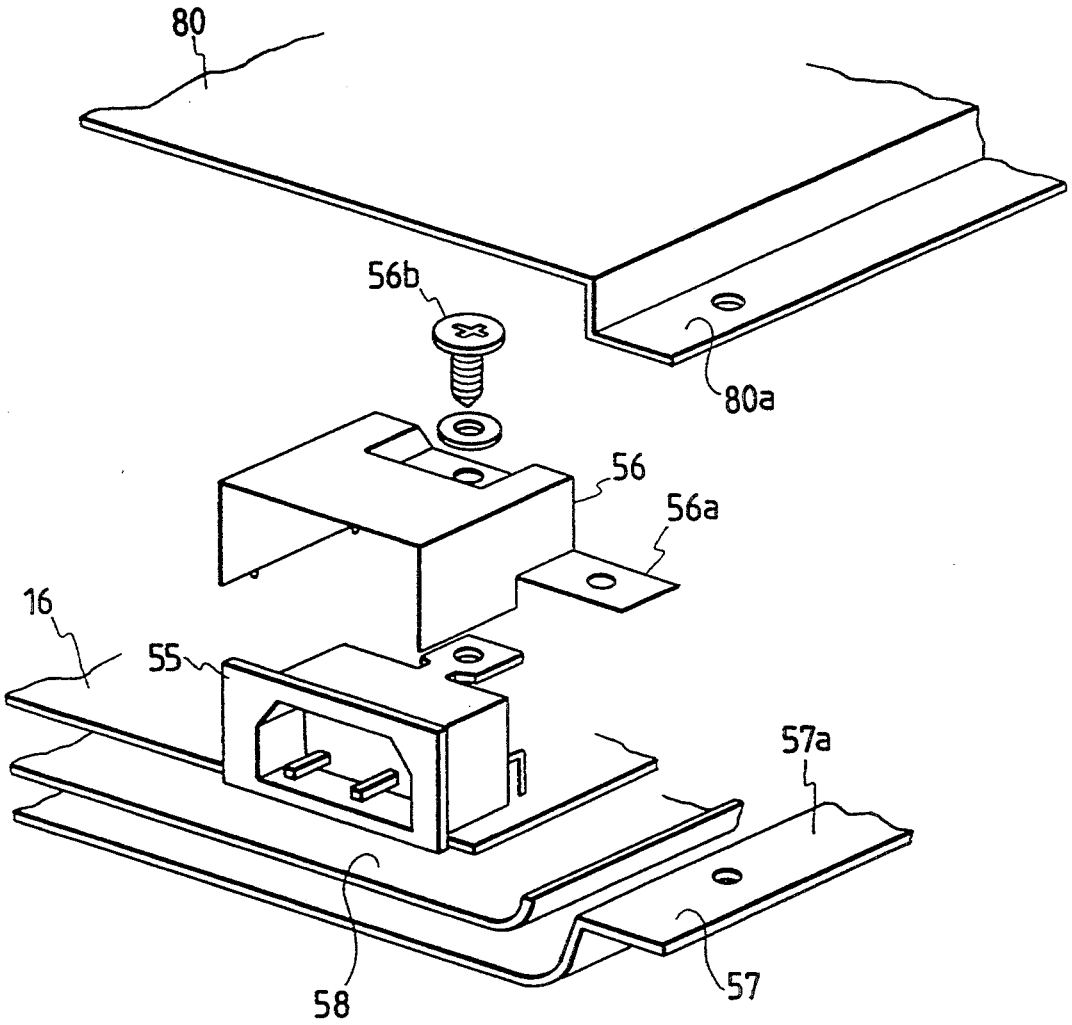
FIG. 10 is a perspective view showing a method of mounting an AC inlet.

As shown in FIGS. 9 and 10, a flange 56*a* of an AC inlet cover 56 consisting of a metal sheet, which is connected to the FG (frame ground) terminal of an AC inlet 55 is clamped/fixed between a flange portion 57*a* of the conductive cover 57 and a flange 80*a* of the convey guide plate 80. With this arrangement, the convey guide plate 80 and the conductive cover 57 are set to an FG potential. Note that reference numeral 55*a* denotes an inlet terminal; and 56*b*, a screw.

In addition, as shown in FIGS. 9 and 10, the flanges 80*a* and 57*a* respectively formed at the edges of the convey guide plate 80 and the conductive cover 57 are brought into contact and fixed with each other, thus constituting a closed structure. The paper feed cassette 70 has a recording sheet P storage portion facing the conductive cover 57. A convey guide portion 57*b* of the conductive cover 57, which is continuous with the convey guide plate 80 constitutes a convey path 66 having an inward curve when viewed from the left so as to be spaced apart from an outlet path wall 70*a* of the paper feed cassette 70 and the inlet convey guide 67.

When the recording sheet P is picked up from the paper feed cassette 70 disposed below the electric equipment unit 59, the recording sheet P is conveyed in contact with the conductive cover 57. Since the potential of the conductive cover 57 is decreased to the FG potential, the charges on the recording sheet P can be removed at the contact portion between the recording sheet P and the conductive cover 57.

With the above-described arrangement, the following advantages can be obtained:

① Since the electric equipment unit 59 is fixed to the frame (not shown) of the apparatus main body A through the conductive cover 57 having high rigidity, the conductive cover 57 serves as a reinforcing member for the frame of the apparatus main body A, thus increasing the strength of the main body frame.

② Since the recording sheet P is conveyed from the paper feed cassette 70 to the transfer unit while the recording sheet P is in contact with the conductive cover 57 whose potential is decreased to the FG potential, the charges on the recording sheet P can be easily removed. Therefore, an improvement in the quality of a transferred image is realized.

③ Since an electric equipment member is housed in the box-like space formed by a material having good surface conductivity, the outside of the electric equipment member constitutes a closed loop of FG. With this arrangement, noise generated by electric circuits in the electric equipment portion can be easily prevented.

④ The conventional arrangement of the portions around the electric equipment unit (i.e., insulating sheet, conductive sheet and insulating resin) can be simplified into (thin film resin and conductive member), thereby further improving the assembly efficiency.

{Process Cartridge}

The arrangement of each component of the process cartridge B mounted in the image forming apparatus A will be described next.

The process cartridge B includes an image bearing member and at least one process means. In this case, the process means includes a charging means for charging the surface of the image bearing member, a developing means for forming a toner image on the image bearing member, a cleaning means for removing the residual toner on the surface of the image bearing member, and the like. As shown in FIG. 1, the process cartridge B of the embodiment is designed such that a charging means 8, an exposure opening 9, a developing means 10, and a cleaning means 11 are arranged around the photosensitive drum 7 as an image bearing member, and these components are covered with a housing constituted by a frame member 12 to form an integral structure. This structure is designed to be detachable from the apparatus main body A.

The arrangements of the respective components of the process cartridge B, i.e., the photosensitive drum 7, the charging means 8, the exposure unit 9, the developing means 10, and the cleaning means 11 will be described below in the order named.

(Photosensitive Drum)

The photosensitive drum 7 according to the embodiment is formed by coating an organic photosensitive layer on the outer surface of a cylindrical drum base member consisting of aluminum. The photosensitive drum 7 is pivotally fixed to the frame member 12. The photosensitive drum 7 is rotated in the direction indicated by the arrow in FIG. 1 in accordance with an image forming operation by transmitting the driving force of a driving motor mounted on the apparatus main body side to a gear (not shown) fixed to one end of the drum 7 in the longitudinal direction.

(Charging Means)

The charging means serves to uniformly charge the surface of the photosensitive drum 7. In the embodiment, a so-called contact charging method is used, in which a charging roller 8 is pivotally mounted on the frame member 12. The charging roller 8 is formed as follows. First a conductive elastic layer is formed on a roller shaft 8*a*. An elastic layer having a high resistance is formed on the conductive elastic layer. A protective film is further formed on the surface of the resultant structure. The conductive elastic layer is formed by dispersing carbon particles in an elastic rubber layer such as an EPDM or NBR layer, and serves to introduce a bias voltage applied to the roller shaft 8*a*. The high-resistance elastic layer is composed of a urethane rubber layer containing a small amount of conductive powder, for example. The high-resistance elastic layer serves to prevent an abrupt drop in bias voltage by restricting a leak current to the photosensitive drum 7 even when the charging roller having high conductivity is brought into contact with pinholes and the like of the photosensitive drum 7. The protective layer is constituted by an N-methylmethoxy nylon layer, for example. The protective layer prevents the plastic material of the conductive elastic layer or of the high-resistance elastic layer from coming into contact with the photosensitive drum 7, thus preventing a change in properties of the surface of the photosensitive drum 7.

In an image forming operation, the charging roller 8 is brought into contact with the photosensitive drum 7 and is rotated upon rotation of the photosensitive drum 7. At this time, by applying DC and AC voltages to the charging roller 8 upon superposing the voltages, the surface of the photosensitive drum 7 is uniformly charged.

(Exposure Unit)

The exposure opening 9 serves to form an electrostatic latent image on the surface, of the photosensitive drum 7, which has been uniformly charged by the charging roller 8, by focusing an optical image radiated from an optical system 1 onto the drum surface. The exposure unit is constituted by an optical path which is formed above the developing means 10 to guide the optical image. The charging roller 8 and the cleaning means 11 are arranged on the upstream side of the optical path with respect to the direction of rotation of the drum 7, and the developing means 10 is arranged on the downstream side.

(Developing Means)

As shown in FIG. 1, the developing means 10 has a toner container 10*a* for storing a toner t. A toner feed member (not shown) which is rotated to feed the toner is arranged in the toner container 10*a*. In addition, a developing sleeve 10 incorporating a magnet (not shown) is arranged to oppose the photosensitive drum 7 with a small gap. The developing sleeve 10 is rotated to form a thin toner layer on its surface. The small gap is ensured by spacers (not shown) which are respectively fixed to the two ends of the developing sleeve 10 in the longitudinal direction to be in contact with the surface of the photosensitive drum 7.

When a toner layer is formed on the surface of the developing sleeve, frictional charges large enough to develop the electrostatic latent image on the photosensitive drum are obtained from the friction between the toner and the developing sleeve. A developing blade 10*b* is arranged to regulate the thickness of a toner layer.

(Cleaning Means)

As shown in FIG. 1, the cleaning means 11 is constituted by a cleaning blade 11 which is brought into contact with the surface of the photosensitive drum 7 to scrape off the residual toner on the drum 7, a scooping sheet (not shown) which is located below the blade 11 and is in slight contact with the surface of the photosensitive drum 7 to scoop the scraped toner, and a waste toner container 11*b* for storing the scraped waste toner.

The above-described process cartridge is a cartridge in which the charging means, the developing means or the cleaning means, and the electrophotographic photosensitive member are integrally incorporated. This cartridge is designed to be detachable from the image forming apparatus. Alternatively, at least one of the charging means, the developing means, and the cleaning means, and the electrophotographic photosensitive member are integrated into a cartridge to be detachable with respect to the main body of the image forming apparatus. In addition, the process cartridge is a cartridge in which at least the developing means and the electrophotographic photosensitive member are integrally incorporated so as to be detachable from the apparatus main body.

According to the present invention described in detail above, there is provided an image forming apparatus which can realize a further reduction in size.

What is claimed is:

1. An image forming apparatus for forming an image on a recording medium, comprising an electric circuit board on which an electric part is mounted, a conductive cover which covers said electric circuit board, an insulating member arranged between a lower surface of said electric circuit board and said conductive cover, and grounding means for grounding said conductive cover, wherein said conductive cover also serves as a convey guide for the recording medium.

2. An image forming apparatus according to claim 1, wherein said conductive cover also serves as a convey guide for guiding a recording medium fed from a feed cassette to a transfer region of an image bearing member.

3. An image forming apparatus according to claim 1, wherein said conductive cover guides a recording medium, on which a toner image is transferred from an image bearing member, to fixing means.

4. An image forming apparatus according to claim 1, wherein said conductive cover is constituted by a steel plate obtained by forming an aluminum coat on an iron plate.

5. An image forming apparatus according to claim 1, wherein said insulating member is composed of a material selected from the group consisting of a modified PPO resin, a polycarbonate resin, an ABS resin, and a high-impact styrol resin.

6. An image forming apparatus according to claim 1, wherein said electric circuit board includes a CPU, a capacitor, a resistor, a connector, and a power supply unit as electric parts.

7. An image forming apparatus according to claim 1, wherein said grounding means includes an AC inlet having a ground terminal.

8. An image forming apparatus according to claim 1, wherein a feed cassette for storing recording media is arranged below said electric circuit board.

9. An image forming apparatus according to claim 1, wherein charging means, developing means or developing means, and an electrophotographic photosensitive member are integrally formed into a cartridge, and said cartridge is detachably mounted, as a process cartridge, in said image forming apparatus.

10. An image forming apparatus according to claim 1, wherein at least one of charging means, developing means, and developing means, and an electrophotographic photosensitive member are integrally formed into a cartridge, and said cartridge is detachably mounted, as a process cartridge, in said image forming apparatus.

11. An image forming apparatus according to claim 1, wherein at least developing means and an electrophotographic photosensitive member are integrally formed into a cartridge, and said cartridge is detachably mounted, as a process cartridge, in said image forming apparatus.

12. An image forming apparatus according to claim 1, wherein said image forming apparatus is a laser beam printer.

13. An image forming apparatus according to claim 1, wherein said image forming apparatus is an electrophotographic copying machine.

14. An image forming apparatus according to claim 1, wherein said image forming apparatus is a facsimile apparatus.

15. An image forming apparatus according to claim 1 or 14, wherein said conductive cover has a surface resistance of about $10^7\ \Omega$ to $10^{16}\ \Omega$.

16. An image forming apparatus according to claim 1 or 14, wherein said conductive cover comprises a conductive upper cover and a conductive lower cover.

17. An image forming apparatus according to claim 1 or 14, wherein to said electric circuit board consists of an image treatment circuit board for effecting image treatment based on signals from a host computer.

18. An image forming apparatus for forming an image on a recording medium, comprising an electric circuit board on which an electric part is mounted, a conductive cover which covers said electric circuit board, grounding means for grounding said conductive cover, a recording medium stacking unit arranged at a lower portion of said apparatus, and reversing means for guiding a recording medium fed from said recording medium stacking unit to an image transfer region upon reversing the recording medium, wherein said conductive cover constitutes a convey path for conveying the recording medium fed from said recording medium stacking unit to said reversing means.

19. An image forming apparatus according to claim 18, wherein said conductive cover is constituted by a steel plate obtained by forming an aluminum coat on an iron plate.

20. An image forming apparatus according to claim 18, wherein said insulating member is composed of a material selected from the group consisting of a modified PPO resin, a polycarbonate resin, an ABS resin, and a high-impact styrol resin.

21. An image forming apparatus according to claim 18, wherein said electric circuit board includes a CPU, a capacitor, a resistor, a connector, and a power supply unit as electric parts.

22. An image forming apparatus according to claim 18, wherein said grounding means includes an AC inlet having a ground terminal.

23. An image forming apparatus according to claim 18, wherein a feed cassette for storing recording media is arranged below said electric circuit board.

24. An image forming apparatus according to claim 18, wherein charging means, developing means or developing means, and an electrophotographic photosensitive member are integrally formed into a cartridge, and said cartridge is detachably mounted, as a process cartridge, in said image forming apparatus.

25. An image forming apparatus according to claim 18, wherein at least one of charging means, developing means, and developing means, and an electrophotographic photosensitive member are integrally formed into a cartridge, and said cartridge is detachably mounted, as a process cartridge, in said image forming apparatus.

26. An image forming apparatus according to claim 18, wherein at least developing means and an electrophotographic photosensitive member are integrally formed into a cartridge, and said cartridge is detachably mounted, as a process cartridge, in said image forming apparatus.

27. An image forming apparatus according to claim 18, wherein said image forming apparatus is a laser beam printer.

28. An image forming apparatus according to claim 18, wherein said image forming apparatus is an electrophotographic copying machine.

29. An image forming apparatus according to claim 18, wherein said image forming apparatus is a facsimile apparatus.

30. An image forming apparatus for forming an image on a recording medium, comprising:

an electrophotographic photosensitive member;

process means for acting on said photosensitive member;

an electric circuit board having an electric source for supplying power to said process means and a control portion for controlling the power supply to said process means;

a conductive cover for covering said electric circuit board and guiding the recording medium in a convey direction;

an insulative member disposed between said electric circuit board and said conductive cover; and grounding means for grounding said conductive cover.

31. An image forming apparatus according to claim 30, wherein said conductive cover comprises a conductive upper cover and a conductive lower cover surrounding said electric circuit board, and said insulative member is an insulative sheet disposed between said electric circuit board and said conductive lower cover.

32. An image forming apparatus according to claim 30 or 31, wherein said insulative member is of a material selected from the group of denalurated polyphenylene oxide resin (PPO), polycarbonate resin (PC), ABS (acrylonitrile/butadiene/styrene copolymer) resin, and high impact styrole resin.

33. An image forming apparatus according to claim 30, wherein said conductive cover is comprised of one of a steel plate made of an iron plate coated by aluminum and a steel plate made of an iron plate vapored by aluminum.

34. An image forming apparatus according to claim 30 or 33, wherein said conductive cover has a surface resistance from about $10^7\ \Omega$ to $10^{16}\ \Omega$.

35. An image forming apparatus according to claim 30, wherein said conductive cover guides the recording medium fed out from a supply cassette to a transfer area where the toner image formed on said photosensitive member is transferred to the recording medium.

36. An image forming apparatus according to claim 35, wherein said conductive cover further guides the recording medium having a toner image transferred from said photosensitive member to a fixing means for fixing the toner image.

37. An image forming apparatus according to claim 30, wherein said grounding means has an AC inlet provided with a ground contact connected to said circuit board.

38. An image forming apparatus according to claim 30 or 37, wherein said electric circuit board consists of an image generating board for effecting image generation based on signals from a host computer.

39. An image forming apparatus according to claim 30, wherein said control portion controls operation of said apparatus in its entirety.

40. An image forming apparatus according to claim 30, wherein said process means includes at least one of charge means for charging said photosensitive member, development means for developing the latent image and cleaning means for cleaning the photosensitive member, and said process means and said photosensitive member are made into a process cartridge, which process cartridge is removably mounted onto a main body of said apparatus.

41. An image forming apparatus according to claim 30 or 40, wherein said apparatus is a laser beam printer.

42. An image forming apparatus for forming an image on a recording medium, comprising:

an electrophotographic photosensitive member;

charge means for charging said photosensitive member;

developing means for developing a latent image formed on said photosensitive member;

transfer means for transferring the toner image formed on said photosensitive member to a recording medium;

an electric circuit board having an electric source for supplying power to said charge means, development means and transfer means, and said electric circuit board having a control portion for controlling said charge means, development means and transfer means;

a conductive cover for covering said electric circuit board, said conductive cover guiding the recording medium in a convey direction and being comprised of a conductive upper cover and a conductive lower cover;

an insulative sheet disposed between said electric circuit board and said conductive lower cover; and grounding means for electrically connecting said conductive cover and said electric circuit board to ground said conductive cover.

43. An image forming apparatus according to claim 42, wherein said insulative member is of a material selected from the group of denalurated polyphenylene oxide resin (PPO), polycarbonate resin (PC), ABS (acrylonitrile/butadiene/styrene copolymer) resin, and high impact styrole resin.

44. An image forming apparatus according to claim 42 or 43, wherein said conductive cover is comprised of one of a steel plate made of an iron plate coated by aluminum and a steel plate made of an iron plate vapored by aluminum.

45. An image forming apparatus according to claim 42, wherein said conductive cover has a surface resistance of about $10^7\ \Omega$ to $10^{16}\ \Omega$.

46. An image forming apparatus according to claim 42, wherein said conductive cover guides the recording medium fed out from a supply cassette to a transfer area where the toner image formed on said photosensitive member is transferred to the recording medium.

47. An image forming apparatus according to claim 42 or 46, wherein said conductive cover further guides the recording medium having a toner image transferred from said photosensitive member to a fixing means for fixing the toner image.

48. An image forming apparatus according to claim 42, wherein said grounding means has an AC inlet provided with a ground contact connected to said electric circuit board.

49. An image forming apparatus according to claim 42 or 48, wherein said electric circuit board consists of an image generating board for effecting image generation based on signals from a host computer.

50. An image forming apparatus according to claim 42, wherein said control portion further controls said apparatus in its entirety.

51. An image forming apparatus according to claim 42, further comprising cleaning means for removing residual toner on said photosensitive member, and wherein said cleaning means, development means, and photosensitive member are made into a process cartridge, which process cartridge is removably mounted onto a main body of said apparatus.

52. An image forming apparatus according to claim 42, further comprising cleaning means for removing residual toner on said photosensitive member and wherein at least one of said cleaning means, said development means, and said photosensitive member is made into a process cartridge, the process cartridge being removably mounted onto a main body of said apparatus.

53. An image forming apparatus according to claim 42, wherein at least said development means and said photosensitive member are made into a process cartridge, the process cartridge being removably mounted onto a main body of said apparatus.

54. An image forming apparatus according to claim 42, wherein said apparatus is a laser beam printer.

55. An image forming apparatus onto which a process cartridge is removably mounted for forming an image onto a recording medium, comprising:

mount means for removably mounting a process cartridge having an electrophotographic photosensitive member and process means for acting onto the photosensitive member;

an electric circuit board having an electric source for supplying power to said process means and a control portion for controlling power supply to said process means;

a conductive cover for covering said electric circuit board and guiding the recording medium in a convey direction;

an insulative member disposed between said electric circuit board and said conductive cover;

grounding means for grounding said conductive cover;

transfer means for transferring the toner image on said photosensitive member of said process cartridge mounted onto said mount means to the recording medium;

fixing means for fixing the toner image transferred onto the recording medium by said transfer means to the recording medium;

recording media stack means disposed below said electric circuit board; and reverse means for reversing surfaces of the recording medium fed out from said recording media stack means, said reverse means then feeding the recording medium to an image transfer area to transfer the toner image from the photosensitive member, and thereafter reversing the recording medium after it has passed through said fixing means to lead it to a record medium receiving means.

56. An image forming apparatus according to claim 55, wherein said conductive cover has a conductive upper cover and a conductive lower cover surrounding said electric circuit board, and said insulative sheet is disposed between said electric circuit board and said conductive lower cover.

57. An image forming apparatus according to claim 55, wherein said insulative member is of a material selected from the group of denalurated polyphenylene oxide resin (PPO), polycarbonate resin (PC), ABS (acrylonitrile/butadiene/styrene copolymer) resin, and high impact styrole resin.

58. An image forming apparatus according to claim 55, 56 or 57, wherein said conductive cover is comprised of one of a steel plate made of an iron plate coated by aluminum and a steel plate made of an iron plate vapored by aluminum.

59. An image forming apparatus according to claim 55, wherein said conductive cover has a surface resistance of about $10^7\ \Omega$ to $10^{16}\ \Omega$.

60. An image forming apparatus according to claim 55, wherein said recording media stack means is a supply cassette and said conductive cover guides the recording medium fed out from the supply cassette to said transfer member.

61. An image forming apparatus according to claim 55 or 60, wherein said conductive cover guides the recording medium having a toner image transferred from said photosensitive member to said fixing means.

62. An image forming apparatus according to claim 55, wherein said grounding means has an AC inlet provided with a ground contact connected to said electric circuit board.

63. An image forming apparatus according to claim 55 or 62, wherein said electric circuit board consists of an image treating board for effecting image treatment based on signals from a host computer.

64. An image forming apparatus according to claim 55, wherein said control portion controls said apparatus in its entirety.

65. An image forming apparatus according to claim 55, wherein said process means includes charge means for charging said photosensitive member, development means for developing a latent image and cleaning means for removing residual toner on said photosensitive member, and wherein said process means and said photosensitive member are made into a process cartridge, which process cartridge is removably mounted onto a main body of said apparatus.

66. An image forming apparatus according to claim 55, wherein said apparatus is a laser beam printer.

67. An image forming apparatus according to claim 39, 40, 42, 51, 52 or 65, wherein said charge means is a charge roller.

68. An image forming apparatus according to claim 42 or 55, wherein said transfer means is a transfer roller.

* * * * *

UNITED STATES PATENT AND TRADEMARK OFFICE

CERTIFICATE OF CORRECTION

PATENT NO. : 5,414,492
DATED : May 9, 1995
INVENTOR(S) : TAKESHI KUBOTA

It is certified that error appears in the above-indentified patent and that said Letters Patent is hereby corrected as shown below:

Column 9,
line 38, "portion 3a5" should read --portion 40a--.

Column 10,
line 57, "reinforming" should read --reinforcing--.

Column 20,
line 45, "denalurated" should read --denaturated--.

Column 21,
line 49, "denalurated" should read --denaturated--.

Column 23,
line 11, "denalurated" should read --denaturated--.

Signed and Sealed this

Twenty-ninth Day of August, 1995

Bruce Lehman

*Attest:*

BRUCE LEHMAN

*Attesting Officer*

*Commissioner of Patents and Trademarks*